US007021481B2

(12) United States Patent
St. Germain et al.

(10) Patent No.: US 7,021,481 B2
(45) Date of Patent: Apr. 4, 2006

(54) CONTAINER LID WITH MULTIPLE OPENINGS

(75) Inventors: Freida St. Germain, Mableton, GA (US); Tim Kilpatrick, Fort Worth, TX (US); James S. Sheffield, Ontario (CA)

(73) Assignee: The Coca-Cola Company, Atlanta, GA (US)

( * ) Notice: Subject to any disclaimer, the term of this patent is extended or adjusted under 35 U.S.C. 154(b) by 164 days.

(21) Appl. No.: 09/870,784

(22) Filed: Jun. 1, 2001

(65) Prior Publication Data

US 2002/0179604 A1 Dec. 5, 2002

(51) Int. Cl.
*B65D 51/18* (2006.01)
*A47G 19/22* (2006.01)

(52) U.S. Cl. ..... 220/254.2; 220/254.3; 220/259.2; 220/709; 220/713; 220/826; 220/832; 220/254.5; 215/230; 215/387; 40/311

(58) Field of Classification Search ..... 40/310, 40/311; 215/230, 235, 387, 388, 324, 328, 215/354; 206/459.5; 220/254.1, 254.2, 220/254.3, 256.1, 259.1, 259.2, 703, 705, 220/709, 711, 713, 826, 847, 254.5, 831, 220/832, 837; 222/545, 556; 229/404, 906.1; D7/449; D9/510, 511, 602, 629, 396.2, 397
See application file for complete search history.

(56) References Cited

U.S. PATENT DOCUMENTS 2,753,051 A * 7/1956 Tupper ..... 220/259.2
2,765,948 A * 10/1956 Paley et al. ..... 220/830
3,016,168 A * 1/1962 Larson ..... 222/480
3,226,001 A * 12/1965 Sequeira ..... 215/388
3,262,612 A * 7/1966 Tabor ..... 220/254.2
3,363,798 A * 1/1968 Garangiotis ..... 220/259.1
3,392,468 A * 7/1968 Wolf ..... 229/906.1
3,409,188 A * 11/1968 Wright ..... 222/480
3,587,944 A * 6/1971 Pehr ..... 220/259.2
3,974,916 A * 8/1976 Bartolucci ..... 116/307
4,164,303 A * 8/1979 Waterbury ..... 220/834
4,361,250 A 11/1982 Foster
4,535,908 A * 8/1985 Dabich ..... 220/484
4,615,459 A 10/1986 Clements
4,693,399 A 9/1987 Hickman et al.
4,717,050 A * 1/1988 Wright ..... 220/259.2
4,738,373 A 4/1988 DeParales
4,741,450 A 5/1988 Braude
4,872,597 A 10/1989 Hanafusa
4,903,870 A * 2/1990 La Vange ..... 220/254.6
4,949,865 A 8/1990 Turner
5,054,640 A 10/1991 Tucker
5,076,425 A * 12/1991 Plone ..... 206/220
5,086,941 A 2/1992 English et al.
5,110,002 A 5/1992 Tucker
5,125,525 A 6/1992 Tucker
5,148,936 A 9/1992 DeGrow (Continued)

*Primary Examiner*—Robin A. Hylton
(74) *Attorney, Agent, or Firm*—Finnegan Henderson Farabow Garrett & Dunner LLP

(57) ABSTRACT

A lid for use with a container may include a panel and a first dispensing opening on the panel. The lid may also include a first closure on the panel, where the first closure may include a second dispensing opening. The first closure may be configured to at least partially cover the first dispensing opening. The lid may further include a second closure on the panel, where the second closure may be configured to cover the second dispensing opening.

12 Claims, 6 Drawing Sheets

U.S. PATENT DOCUMENTS 5,183,172 A 2/1993 Boller
5,244,113 A 9/1993 Stymiest
D341,380 S * 11/1993 Morgan, Jr. et al. ..... D20/37
5,271,531 A * 12/1993 Rohr et al. ..... 222/212
5,297,687 A * 3/1994 Freed ..... 215/236
5,402,904 A 4/1995 Close
5,415,312 A 5/1995 Mueller
5,462,189 A * 10/1995 Pierce ..... 220/815
5,490,609 A 2/1996 Lane et al.
5,495,941 A * 3/1996 Leonard ..... 220/254.4
5,503,289 A 4/1996 Fox
5,735,426 A * 4/1998 Babcock et al. ..... 215/256
5,743,427 A 4/1998 Monus
5,799,814 A 9/1998 Schaefer et al.
5,934,493 A 8/1999 Han
5,938,056 A * 8/1999 Ma ..... 215/237
5,975,368 A * 11/1999 Wood ..... 222/151
5,979,697 A 11/1999 Kim
D418,363 S 1/2000 Barnes et al.
6,070,752 A * 6/2000 Nava et al. ..... 206/217
6,082,575 A 7/2000 Skoskiewicz et al.
6,082,944 A 7/2000 Bachmann et al.
6,089,411 A * 7/2000 Baudin et al. ..... 222/212
6,095,033 A 8/2000 Melton
6,102,236 A 8/2000 Ohlsson et al.
6,109,487 A * 8/2000 Hashimoto ..... 222/556
6,158,155 A * 12/2000 Boney ..... 215/230
6,158,632 A * 12/2000 Ekkert ..... 222/556
6,244,456 B1 * 6/2001 Hanlon ..... 116/307
D452,797 S * 1/2002 Palefsky et al. ..... D7/511
6,382,476 B1 * 5/2002 Randall et al. ..... 215/237
2002/0036207 A1 * 3/2002 Ohuo et al. ..... 220/830
2002/0096532 A1 * 7/2002 Berge et al. ..... 220/831

* cited by examiner

CONTAINER LID WITH MULTIPLE OPENINGS

TECHNICAL FIELD

The invention relates generally to a container lid and, more particularly, to a container lid having a plurality of differently-configured openings having a different dispensing function.

BACKGROUND

Conventional container lids include at least one opening for dispensing a liquid, a semi-solid, a powder, a flake, a granular article, or the like. For example, a conventional lid for a beverage container may include an opening for pouring, an opening for chugging, an opening for sipping, an opening configured to receive a straw, or the like. Often times, the lid includes a flap for covering, closing, and/or sealing the opening.

Similarly, a conventional lid for a powdery, flaky, or granular article may include a large opening for rapid dispensing and/or receiving a spoon or one or more small openings for a more controlled dispensing, for example, by shaking. Again, the lid may include a flap for covering, closing, and/or sealing the opening or openings.

Other conventional container lids include more than one opening. For example, a liquid container may have a lid with a large, rapid-pour opening and a small, drinking opening. As another example, a conventional lid for spices may include a large opening configured to receive a spoon and a smaller opening for shaking the product from the container. Typically, conventional lids with a plurality of openings have the openings positioned at opposite sides of the lid from one another.

SUMMARY OF THE INVENTION

According to one aspect of the invention, a lid for use with a container may comprise a panel and a First dispensing opening on the panel. The lid may also include a first closure on the panel, where the first closure may include a second dispensing opening and may be configured to at least partially cover the first dispensing opening. The lid may further include a second closure on the panel, where the second closure may be configured to cover the second dispensing opening.

According to another aspect of the invention, a closure for use with a container may include a panel, a dispensing opening on the panel, a first flap on the panel, and a second flap on the panel. The first flap may be configured to reduce a size of the dispensing opening, and the second flap may be configured to close the dispensing opening.

According to yet another aspect of the invention, a container assembly may include a container, a lid configured for mounting to the container, and a dispensing opening on the lid. The lid may include a first flap that may be configured to reduce a size of the dispensing opening and a second flap that may be configured to close the dispensing opening.

According to another embodiment of the invention, a closure for use with a container may comprise a panel, a first dispensing opening on the panel, a first flap on the panel, and a second flap on the panel. The first flap may include a second dispensing opening may be configured to be pivotal between an open position exposing the first dispensing opening and a closed position modifying the first dispensing opening to the second dispensing opening. The second flap may be configured to be pivotal between an open position exposing the first flap and the second dispensing opening and a closed position covering the first flap and the second dispensing opening.

According to yet another embodiment of the invention, a lid for use with a container containing a beverage may include a pouring assembly in the lid through which a beverage may be dispensed through a dispensing opening. The lid may also include a straw access assembly facilitating dispensing of the beverage through a straw, and the pouring assembly and the straw access assembly may be superimposed in a same lid region. The pouring assembly and the straw access assembly may also be interconnected and may facilitate selective use of one of the pouring assembly and the straw access assembly for dispensing through the lid.

According to still another embodiment of the invention, a method of selectively dispensing a beverage from a container through a wall thereof may include providing a pouring assembly in the wall and providing a straw access assembly superimposed in a same lid region as the pouring assembly. The method may also include selectively utilizing one of the pouring assembly and the straw access assembly for dispensing through the lid.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate exemplary embodiments of the invention and, together with the description, serve to explain the principles of the invention. In the drawings.

DETAILED DESCRIPTION

Reference will now be made in detail to embodiments of the invention, examples of which are illustrated in the accompanying drawings.

Figure 1:
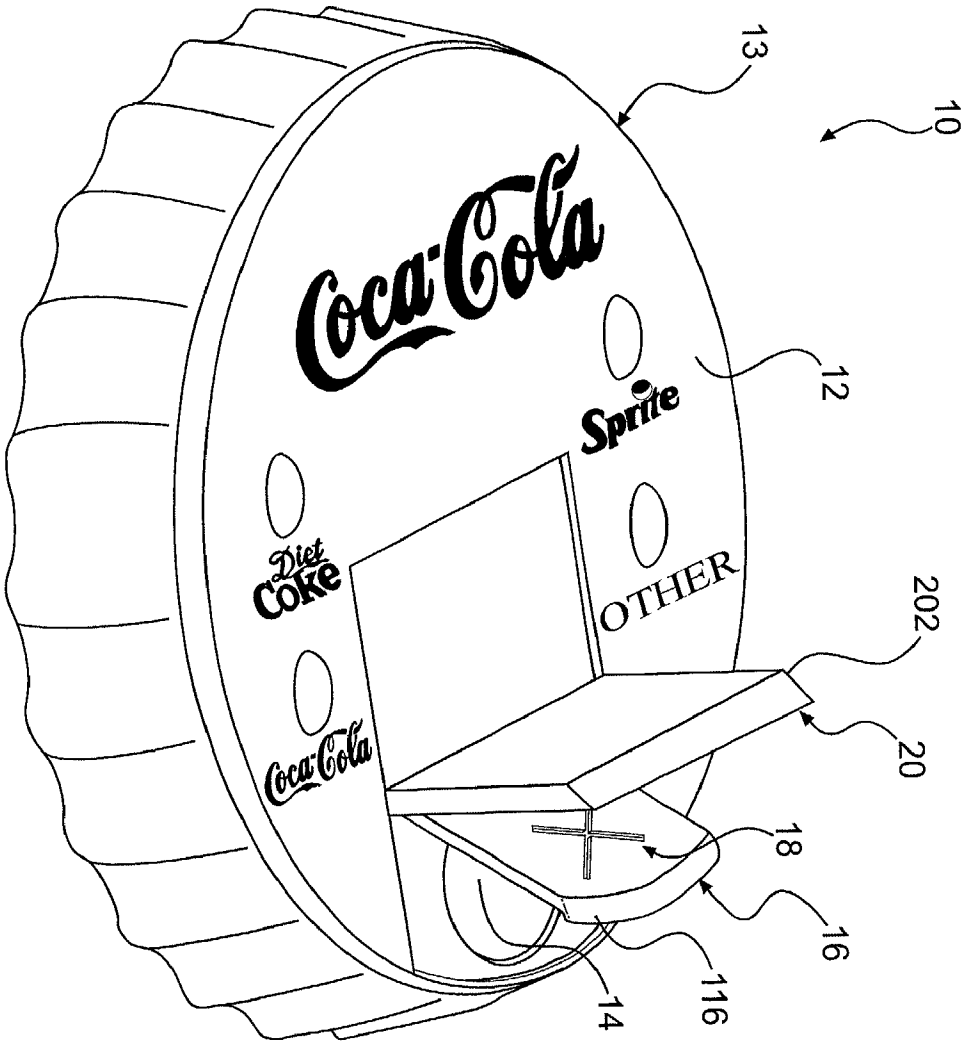
FIG. 1 is a perspective view of a container lid in accordance with an embodiment of the present invention.
Figure 2:
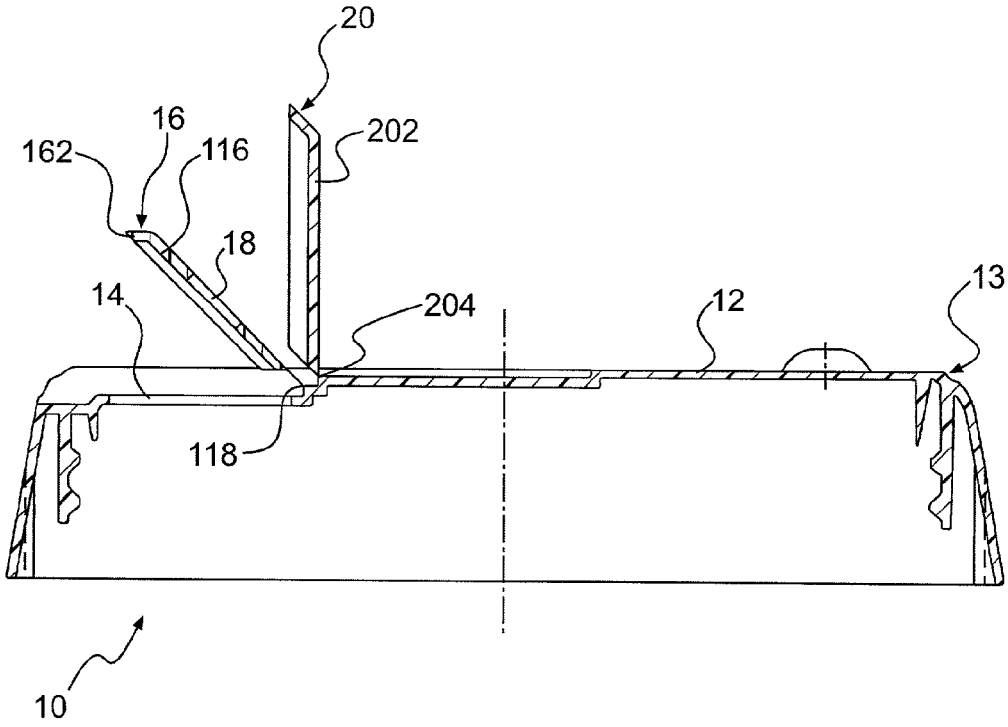
FIG. 2 is a side view of the container lid shown in FIG. 1.

In accordance with the present invention, a container lid is provided. Referring to FIGS. 1 and 2, a container lid 10 may include a wall or panel 12 that may be configured to substantially cover an opening of a container. The panel 12 may be shaped to match an opening of a container. For example, an outer periphery 13 of the panel 12 may be circular to match a circular opening of a container. However, it should be appreciated that the outer periphery may be shaped as an oval, a square, a triangle, a rectangle, or the like so as to match a shape of a container opening.

The panel 12 may include a first opening 14 that may be used to dispense a product from a container. The panel 12 may also include a first closure 16. The first closure 16 may be movably associated with the panel 12 such that the first closure 16 may be configured to cover, at least partially, the first opening 14. For example, the first closure 16 may include a flap 116 pivotally mounted along a first edge 118 to the panel 12.

The first closure 16 may include a second opening 18. The second opening 18 may modify the size and/or the configuration of the first opening 14. For example, the first opening 14 may be a large opening configured for chugging a liquid beverage, while the second opening 14 may include a reduced opening configured to receive a straw or configured for sipping a liquid beverage. In the case of a solid product, the first opening 14 may be a large opening configured to receive a spoon or configured to rapidly pour out a product, while the first closure may include a reduced second opening or a plurality of reduced openings configured to shake out a product or to pour out a product at a slower rate. It should be appreciated that the first and second openings 14,18 may take on any of a plurality of configurations, for example, where the second opening 18 modifies the first opening 14.

The panel 12 may further include a second closure 20. The second closure 20 may be movably associated with the panel 12 such that the second closure 20 may be configured to cover, at least partially, the first opening 14 and the second opening 18. For example, the second closure 20 may include a flap 202 pivotally mounted along a first edge 204 to the panel 12. In addition, the first and second closures 16, 20 may be pivotally mounted about edges 118, 204 that are substantially parallel to one another.

Figure 3:
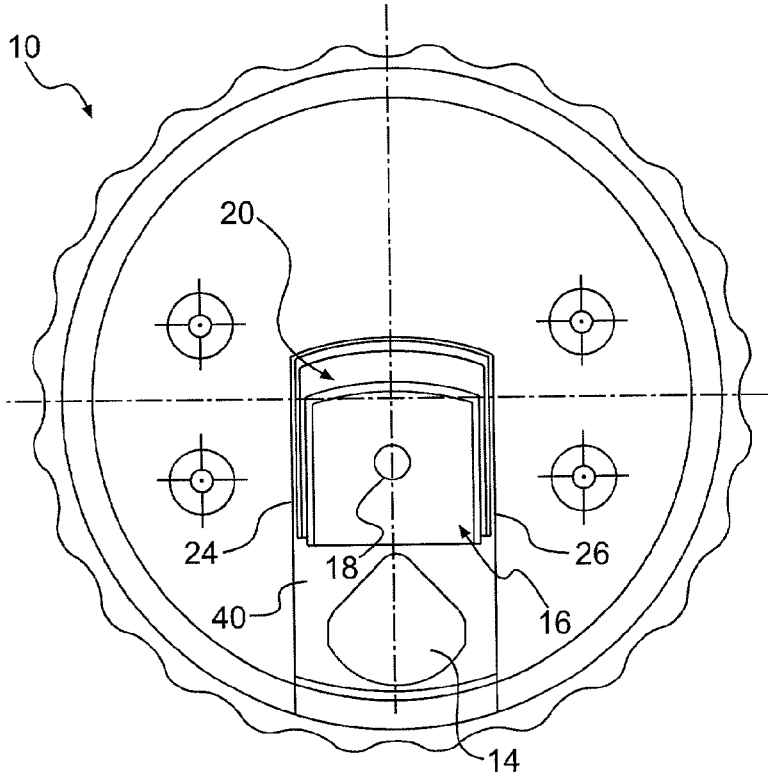
FIG. 3 is a top view of a container lid in accordance with an embodiment of the invention.
Figure 4:
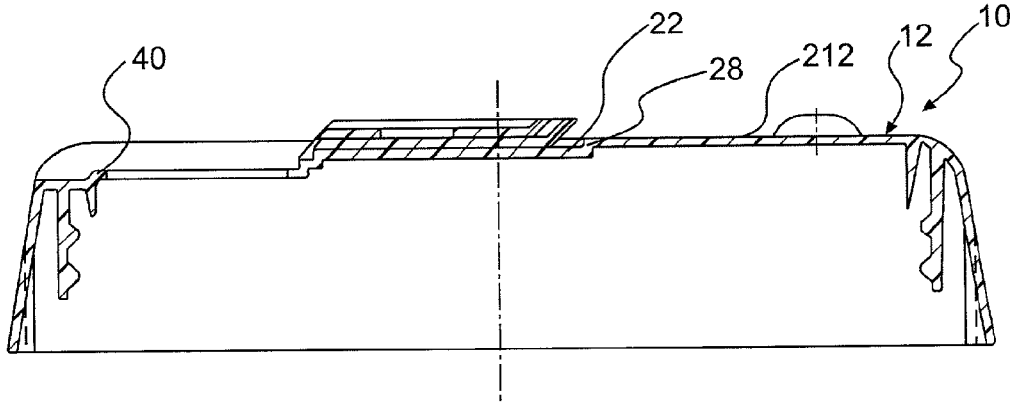
FIG. 4 is a side view of the container lid shown in FIG. 3.
Figure 7:
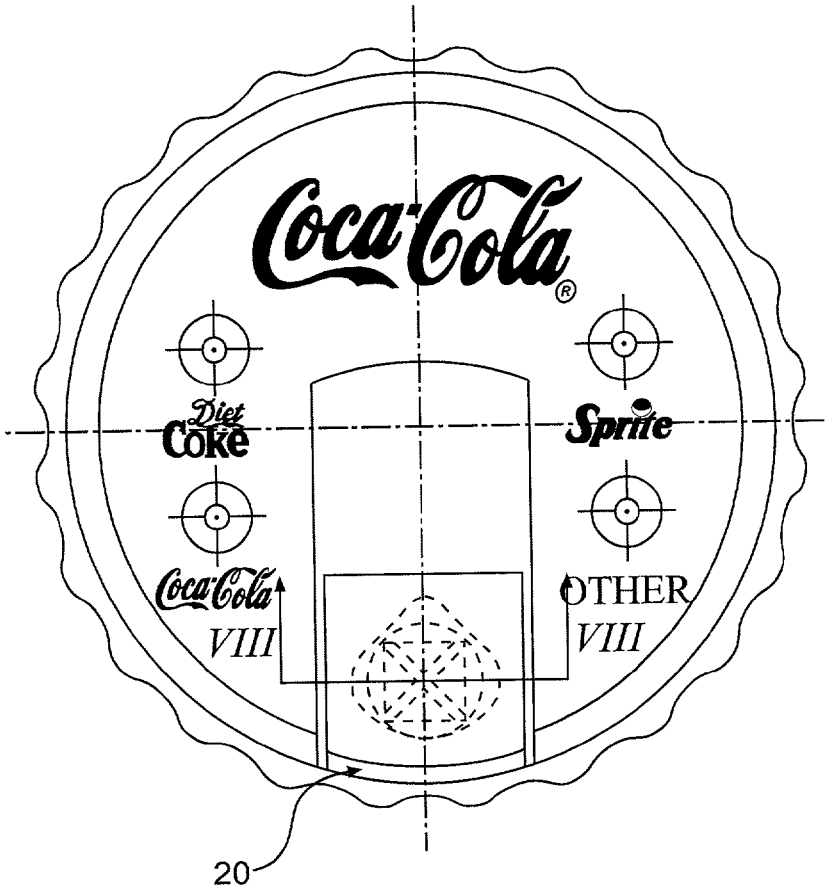
FIG. 7 is a top view of a container lid in accordance with an embodiment of the invention.
Figure 8:
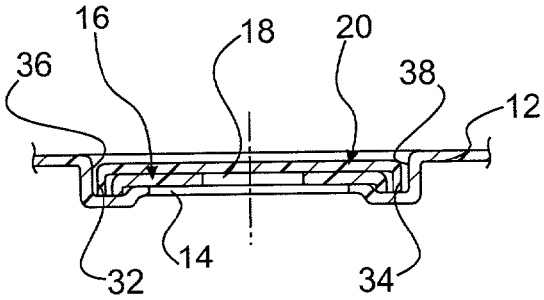
FIG. 8 is a partial, cross-sectional view of the container lid along line VIII—VIII of FIG. 7.

The first and second closures 16, 20 may be movably positioned such that the first opening 14 is exposed or such that the second opening 18 is exposed or such that the first and second openings 14, 18 are both closed. For example, while the first opening 14 is exposed, the first and second closures 16, 20 may be superimposed on one another and on a first offset region 22 of the panel 12, as shown in FIGS. 3 and 4. While the first and second openings 14,18 are closed, as shown in FIGS. 7 and 8, the first and second closures 16, 20 may be superimposed on one another and on a second offset region 40 of the panel 12.

Further, the first and second closures 16, 20 may both pivot in a first direction when exposing the first opening 14 and in a second direction when closing the lid 10. For example, when viewed from the side as in FIG. 2, the first and second closures 16, 20 pivot in a clockwise direction when exposing the first opening 14 and in a counter-clockwise direction when closing the lid 10.

It should also be appreciated that the second closure 20 may include a third opening (not shown) that may modify the size and/or the configuration of the second opening 18. For example, the panel 12 may include a large first opening 14 configured for chugging or rapidly pouring a liquid beverage, the first closure 16 may include a smaller second opening 18 configured for sipping or more slowly pouring a liquid beverage, and the second closure 20 may include a further reduced third opening (not shown) to receive a straw, for example, an opening formed by a plurality of retaining fingers configured to resiliently separate so that a straw may be inserted through and held by the retaining fingers.

In one exemplary embodiment, as shown in FIGS. 3 and 4, the first and second closures 16, 20 may be securely latched to open positions exposing the first opening 14. In the embodiment of FIG. 3, the second opening 18 may reduce the size and/or shape of the first opening 14 and may be configured to receive an object, for example, a straw. A straw may be received in a substantially interference fit relationship. The first closure 16 may be latched to the second closure 20 by way of, for example, an interference fit relationship between the closures 16, 20. It should be appreciated that the first closure 16 may be latched to the second closure 20 by any other mechanism known in the art.

The second closure 20 may be latched to a first offset region 22 of the panel 12 by way of, for example, an interference fit relationship between the second closure 20 and at least one wall 24, 26, 28 of the offset region 22. The first offset region 22 lies below a plane of a non-offset region 212 of the panel 12, when viewed from the side as in FIG. 4. The first closure 16 may be latched to the second closure 20 regardless of whether the second closure 20 is attached to the panel 12. It should be appreciated that the second closure 20 may be latched to the panel 12 by any other mechanism known in the art.

Figure 5:
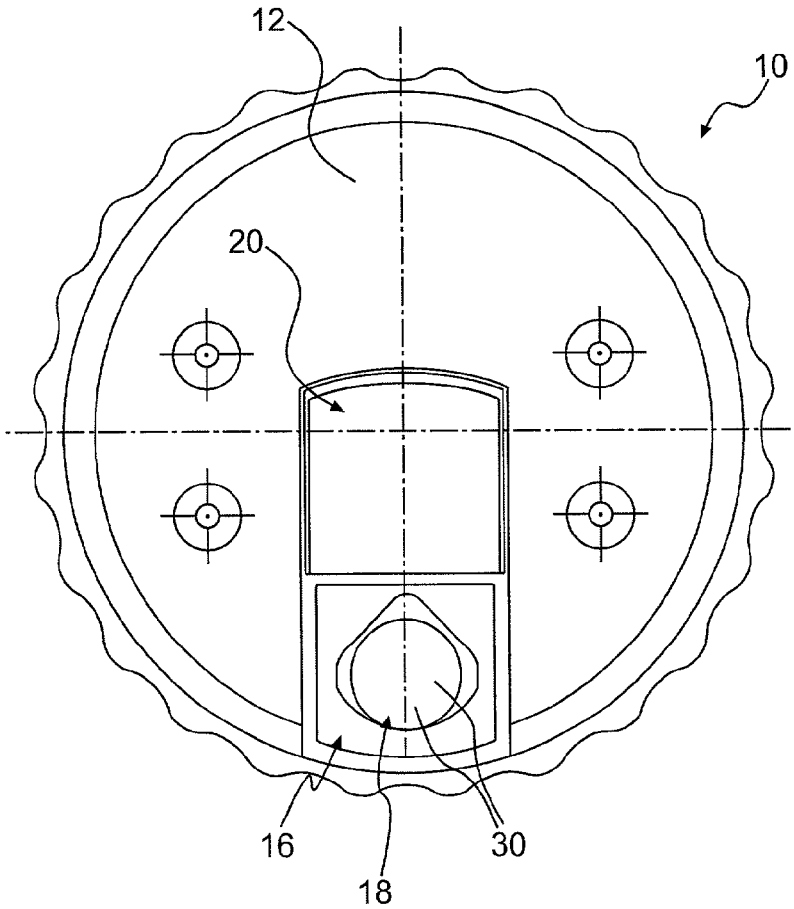
FIG. 5 is a top view of a container lid in accordance with an embodiment of the invention.
Figure 6:
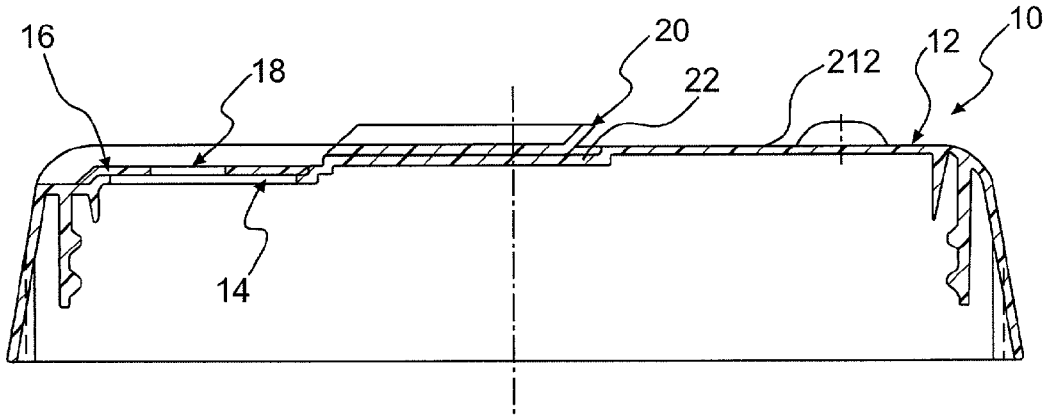
FIG. 6 is a side view of the container lid shown in FIG. 5.

Referring to FIGS. 5 and 6, the second closure 20 may be latched to the panel 12 in an open position while the first closure 16 occupies a closed position that at least partially covers the first opening 14. In the exemplary embodiment shown in FIG. 5, the second opening 18 may include a plurality of converging retaining fingers 30 configured to separate upon insertion of an object, for example, a straw, and to hold the object sufficiently securely that the object does not fall out of the second opening 18. The first closure 16 may latch to the second offset region 40 through, for example, an interference fit or similar means. For example, as shown in FIGS. 2 and 6, an outward-most portion 162 of the first closure 16 may be configured to engage a raised lip on the second offset region 40.

Figure 9:
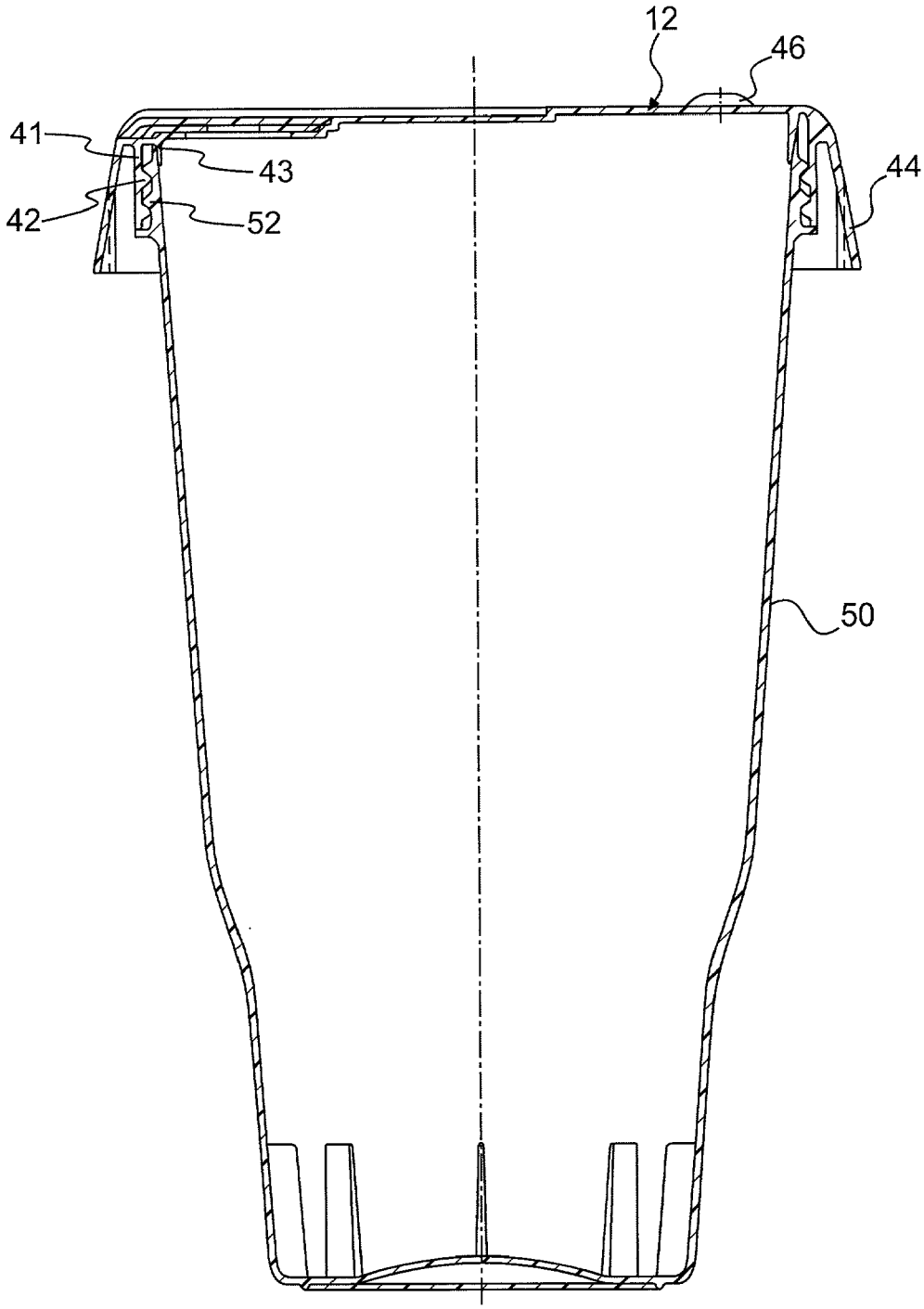
FIG. 9 is a side view of a container lid and container in accordance with an embodiment of the invention.

As shown in FIGS. 7–9, the second closure 20 may occupy a closed position that covers the first closure 16 and closes the second opening 18. Referring to FIG. 8, the second closure 20 may include side edges 32, 34 configured to securely latch the second closure 20 to the panel 12 by an interference fit relationship with corresponding side walls 36, 38 of a second offset region 40 (shown in FIGS. 3–6) of the panel 12. Referring to FIGS. 4 and 6, the second offset region 40 may be further offset from the non-offset region 212 than the first offset region 22, when viewed from the side. Alternatively or additionally, the second closure 20 may latch to the first closure 16, for example, by an interference fit, when disposed in a closed position. It should be appreciated that the second closure 20 may be securely latched to the panel 12 in a closed position by any other mechanism known in the art.

FIG. 9 illustrates an exemplary embodiment of a container lid 10, such as those described above, in combination with a container 50, for example, a liquid beverage container. The container lid 10 may be secured to the container 50 by, for example, a first projection 41 extending from the panel 12 and having screw threads 42 engaging screw threads 52 on the container 50. The panel 12 may include a second projection 43 extending substantially parallel to the first projection 41 and configured to engage a side of the container 50 opposite the screw threads 42, 52. The lid 10 may be secured to the container 50 by other known mechanisms, for example, a lid snap fit over a lip on a container, an interference relationship between lid and container, and the like.

As shown throughout the drawings, the container lid 10 may include a flange 44, for example, a corrugated flange, about the periphery of the panel 12. The flange may extend downward and slightly outward from the panel 12, when viewing the lid 10 from the side. When viewed from the top, as in FIGS. 3, 5, and 7, the shape of the lid, including the corrugated flange, may simulate the appearance of a bottle top design, for example, a COCA-COLA® bottle top design, including a bottle cap, for example, a COCA-COLA® bottle cap.

The panel 12 may also include one or more upwardly-extending projections 46, when viewing the lid 10 from the side. The projections 46 may be configured to be indented upon application of a predetermined force. The projections 46 may be labeled such that indentation of a projection 46 may provide an indication of a product in a container covered by the lid 10.

It should be appreciated that a container lid in accordance with the invention may be formed by, for example, molding, extrusion, thermoforming, or the like. In one exemplary embodiment, a container lid may be formed by injection molding and may have an initial configuration, for example, substantially similar to that shown in FIGS. 1 and 2. Regardless of the initial configuration of a molded container lid formed, for example, of plastic, the first and second closures may be resiliently biased to the initial configuration.

In use, a beverage may be selectively dispensed from a container 50 through the panel 12 of the container lid 10. A user may selectively position the first closure 16 and the second closure 20 so as to selectively utilize the first opening 14 or the second opening 18 for dispensing through the lid 10. Additionally, the first and second closures 16, 20 may be selectively positioned to cover the first and second openings 14, 18, which may thereby close the lid 10.

It will be apparent to those skilled in the art that various modifications and variations can be made to the container lid without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

What is claimed is:

1. A lid for use with a container, comprising:

a panel of unitary construction comprising a first closure and a second closure, the panel being configured to latch the second closure in an open position;

a first dispensing opening in the panel, the first closure being configured to at least partially cover the first dispensing opening; and a second dispensing opening in the first closure, the second closure being configured to cover the second dispensing opening, wherein the second closure is configured to latch the first closure in an open position and the first closure includes a first flap configured to pivot about a first axis and the second closure includes a second flap configured to pivot about a second axis, the first and second axes being substantially parallel to one another.

2. The lid of claim 1, wherein the first flap and the second flap are configured to pivot in a same first direction when closing the lid and in a same second direction when exposing the first dispensing opening.

3. A lid for use with a container, comprising:

a panel of unitary construction comprising a first flap and a second flap, the panel being configured to latch the second flap in an open position; and a dispensing opening in the panel, the first flap being configured to reduce a size of the dispensing opening, the second flap being configured to close the dispensing opening, wherein the first flap includes a plurality of resilient members configured to receive a straw and maintain engagement with the straw and the first flap is configured to pivot about a first axis and the second flap is configured to pivot about a second axis, the first and second axes being substantially parallel to one another.

4. The lid of claim 3, wherein the first flap and the second flap are configured to pivot in a same first direction when closing the lid and in a same second direction when exposing the first dispensing opening.

5. A container assembly comprising:

a container; and a lid according to claim 3 on the container.

6. The assembly of claim 5, wherein the first flap and the second flap are configured to pivot in a same first direction when closing the closure and in a same second direction when exposing the first dispensing opening.

7. A lid for use with a container, comprising:

a panel comprising a first flap and a second flap, the panel being configured to latch the second flap in an open position;

a first dispensing opening in the panel; and a second dispensing opening in the first flap, the first flap being pivotal between an open position exposing the first dispensing opening and a closed position modifying the first dispensing opening to the second dispensing opening, and the second flap being pivotal between an open position exposing the first flap and the second dispensing opening and a closed position covering the first flap and the second dispensing opening, wherein the panel, first flap, and second flap are formed as a single piece of unitary construction, wherein the second dispensing opening is configured to receive a straw and the first flap includes a plurality of resilient members configured to receive the straw and maintain engagement with the straw, and wherein the first flap is configured to pivot about a first axis and the second flap is configured to pivot about a second axis, the first and second axes being substantially parallel to one another.

8. The closure of claim 7, wherein the first flap and the second flap are configured to pivot in a same first direction when closing the lid and in a same second direction when exposing the first dispensing opening.

9. A container assembly, comprising:

a container; and a lid according to claim 1 on the container.

10. The assembly of claim 9, wherein the first closure and the second closure are configured to pivot in a same first direction when closing the lid and in a same second direction when exposing the first dispensing opening.

11. A lid for use with a container, comprising;

a panel of unitary construction comprising a first flap and a second flap, the panel being configured to latch the second flap in an open position; and a dispensing opening in the panel, the first flap being configured to reduce a size of the dispensing opening, the second flap being configured to close the dispensing opening, wherein the first flap includes a plurality of resilient members configured to receive a straw and maintain engagement with the straw and the second flap is configured to latch the first flap in an open position.

12. A lid for use with a container, comprising;

a panel comprising a first flap and a second flap, the panel being configured to latch the second flap in an open position;

a first dispensing opening in the panel; and a second dispensing opening in the first flap, the first flap being pivotal between an open position exposing the first dispensing opening and a closed position modifying the first dispensing opening to the second dispensing opening, and the second flap being pivotal between an open position exposing the first flap and the second dispensing opening and a closed position covering the first flap and the second dispensing opening, wherein the panel, first flap, and second flap are formed as a single piece of unitary construction and the second flap is configured to latch the first flap in an open position.

* * * * *